US009259743B2

(12) United States Patent
Hanna et al.

(10) Patent No.: US 9,259,743 B2
(45) Date of Patent: Feb. 16, 2016

(54) SPLASHLESS SPRAY HEAD

(71) Applicant: Kohler Co., Kohler, WI (US)

(72) Inventors: Ken S. Hanna, Bellingham, WA (US); Pete Kajuch, Brookfield, WI (US); Gregory De Swarte, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 20 days.

(21) Appl. No.: 14/207,244

(22) Filed: Mar. 12, 2014

(65) Prior Publication Data

US 2014/0263760 A1 Sep. 18, 2014

Related U.S. Application Data

(60) Provisional application No. 61/785,107, filed on Mar. 14, 2013.

(51) Int. Cl.

| | |
|---|---|
| ***B05B 1/14*** | (2006.01) |
| ***B05B 1/06*** | (2006.01) |
| ***B05B 1/22*** | (2006.01) |
| ***B05B 1/28*** | (2006.01) |
| ***B05B 15/04*** | (2006.01) |
| *E03C 1/04* | (2006.01) |

(52) U.S. Cl.
CPC ... *B05B 1/14* (2013.01); *B05B 1/06* (2013.01); *B05B 1/22* (2013.01); *B05B 1/28* (2013.01); *B05B 15/0431* (2013.01); *E03C 1/0405* (2013.01)

(58) Field of Classification Search
CPC ..... B05B 1/1636; B05B 1/169; B05B 1/18; B05B 12/002
USPC ..... 239/558, 548, 551, 553.3, 596, 556
See application file for complete search history.

(56) References Cited

U.S. PATENT DOCUMENTS

| | | | | |
|---|---|---|---|---|
| 1,823,635 A * | 9/1931 | Williams | ..... | 239/558 |
| 2,127,188 A | 8/1938 | Schellin et al. | | |
| 3,524,591 A | 8/1970 | Samuels et al. | | |
| 4,398,669 A | 8/1983 | Fienhold | | |
| 4,528,070 A * | 7/1985 | Gamblin | ..... | 101/128.4 |

(Continued)

FOREIGN PATENT DOCUMENTS

| | | |
|---|---|---|
| EP | 1477229 | 11/2004 |
| JP | 402142638 | 12/1990 |

(Continued)

OTHER PUBLICATIONS

European Search Report dated Jun. 16, 2014 for Application No. 14159657.7, 6 pages.

*Primary Examiner* — Davis Hwu
(74) *Attorney, Agent, or Firm* — Foley & Lardner LLP

(57) ABSTRACT

A spray head for a sprayer includes a body portion that receives a supply of fluid and a head portion in fluid communication with the body portion. The head portion of the spray head includes an outer surface which includes a plurality of spray nozzles used to direct a high velocity fluid flow from the spray head and a plurality of spray holes arranged as an outer ring which concentrically surrounds the spray nozzles and directs a lower velocity curtain of water that substantially surrounds the high velocity fluid flow. The lower velocity curtain of water reduces splashing that may result from the high velocity spray directed from the spray nozzles.

21 Claims, 4 Drawing Sheets

(56) References Cited

U.S. PATENT DOCUMENTS

| | | | | |
|---|---|---|---|---|
| 5,145,114 | A | 9/1992 | Monch | |
| 6,164,566 | A | 12/2000 | Hui-Chen | |
| 6,302,339 | B1 | 10/2001 | Chou | |
| 6,370,713 | B2 | 4/2002 | Bosio | |
| 6,412,711 | B1 * | 7/2002 | Fan | 239/446 |
| 6,612,507 | B1 | 9/2003 | Meyer et al. | |
| 7,004,409 | B2 | 2/2006 | Okubo | |
| 7,850,098 | B2 | 12/2010 | Vogel et al. | |
| 8,205,812 | B2 * | 6/2012 | Hester et al. | 239/589.1 |
| 2005/0145554 | A1 | 7/2005 | Cunningham et al. | |
| 2007/0194148 | A1 | 8/2007 | Rosko et al. | |
| 2007/0246578 | A1 * | 10/2007 | Bulan et al. | 239/589 |
| 2011/0079657 | A1 | 4/2011 | Vogel et al. | |

FOREIGN PATENT DOCUMENTS

| | | |
|---|---|---|
| JP | 2006188831 | 7/2006 |
| JP | 2007138662 | 6/2007 |

* cited by examiner

SPLASHLESS SPRAY HEAD

CROSS-REFERENCE TO RELATED PATENT APPLICATIONS

This application claims priority from U.S. Provisional Application No. 61/785,107, filed Mar. 14, 2013, incorporated herein by reference in its entirety.

BACKGROUND

The present disclosure relates generally to the field of sprayers. For example, a sprayer may be used with a kitchen faucet as an extendable feature of a faucet spout, or as a side-spray. In other applications, a sprayer may be used as an attachment to a garden hose, or as a component of a pressure washer. Conventional sprayers are typically fluidly coupled to a water source having an inlet water pressure. Water sprayers also typically include a valve that controls the flow of water through a dispensing end of the sprayer. The dispensing end of a sprayer typically includes a spray head, and the configuration of the spray head generally determines various aspects of the water that is dispensed (i.e. water that is sprayed). For example, the configuration of a spray head may determine the general shape of the spray (i.e., whether the geometry of the spray is narrow, flat, conical, etc.). Some spray heads may include a nozzle, and the size, shape, and position of the nozzle may determine the direction and velocity of the water that is sprayed.

Commonly, a sprayer may be configured to increase the water pressure at the dispensing end of the sprayer, thereby increasing the velocity of the water that is dispensed. This type of sprayer can be useful, for example, to wash dishes. A sprayer that provides a high-velocity spray may be difficult for a user to control. As a result, the water dispensed from a sprayer may deflect off of a cleaning surface, such as a dish, and soak, splash or spray a surrounding object, such as a countertop or the person using the sprayer. Therefore, using a sprayer to wash objects can have many unintended and undesirable consequences. Therefore, a need exists for a sprayer that can produce a high-velocity spray that does not deflect off of an intended cleaning surface.

Further, the need to conserve water has increased due to its short supply in various parts of the world. In order to increase water conservation, various federal laws and regulations may limit water consumption in kitchens and bathrooms. For example, the Federal Energy Policy Act of 1992 currently limits the flow rates of faucets and spray heads used in kitchens to 2.2 gallons per minute (gpm). Therefore, a need exists to provide a sprayer that can operate effectively, by providing a stream of high velocity water that is not deflected off a surface, while also operating efficiently, so that water is conserved.

SUMMARY

An exemplary embodiment of the disclosure relates to a spray head for a sprayer. The spray head includes a body portion that receives a supply of fluid and a head portion in fluid communication with the body portion. The head portion includes an outer surface and a plurality of spray nozzles configured to direct a high velocity spray therefrom and arranged in a central portion therein. The head portion also includes a plurality of spray holes arranged as an outer ring therein. The spray holes surround the spray nozzles, and the spray holes are configured to direct a lower velocity fluid flow in a direction generally parallel to a longitudinal axis of the body portion. The spray holes are configured such that the lower velocity fluid flow reduces splashing that may result from the high velocity spray when the supply of fluid is in fluid communication with both the spray holes and the spray nozzles.

Another embodiment of the disclosure relates to a spray head that includes a body portion that receives a supply of fluid and a head portion in fluid communication with the body portion. The head portion includes a plurality of spray holes and a plurality of spray nozzles that extend therethrough. The spray nozzles are configured to direct a high velocity spray from the head portion and the spray holes surround the spray nozzles. The spray holes are configured to direct a lower velocity curtain of water that substantially contains the high velocity spray when the spray holes and spray nozzles are in fluid communication with the supply of fluid. The spray holes are further configured such that the lower velocity curtain of water effectively reduces splashing that may result from the high velocity spray when the supply of fluid is in fluid communication with both the spray holes and the spray nozzles.

Yet another embodiment of the disclosure relates to a spray head that includes a body portion that receives a supply of fluid and a head portion in fluid communication with the body portion. The head portion includes a plurality of spray holes and a plurality of spray nozzles that extend therethrough. The spray nozzles are configured to direct a high velocity spray from the head portion. The spray holes surround the spray nozzles and are spaced approximately at most 1 mm apart. When the supply of fluid is in fluid communication with the spray holes, a fluid flow dispensed through the spray holes is substantially cylindrical.

DETAILED DESCRIPTION

According to an exemplary embodiment, a sprayer 4 may be used, for example, in a faucet assembly (not shown in the FIGURES). A sprayer 4 may be used with various types of faucet assemblies, such as a kitchen faucet, bathroom faucet, or a faucet for a laundry room. Such sprayers may be configured as, but not limited to, a pull-out sprayer for a faucet spout, or as a side spray attachment. A sprayer may also be used as an attachment for a garden hose or pressure washer, or other suitable application.

Figure 1:
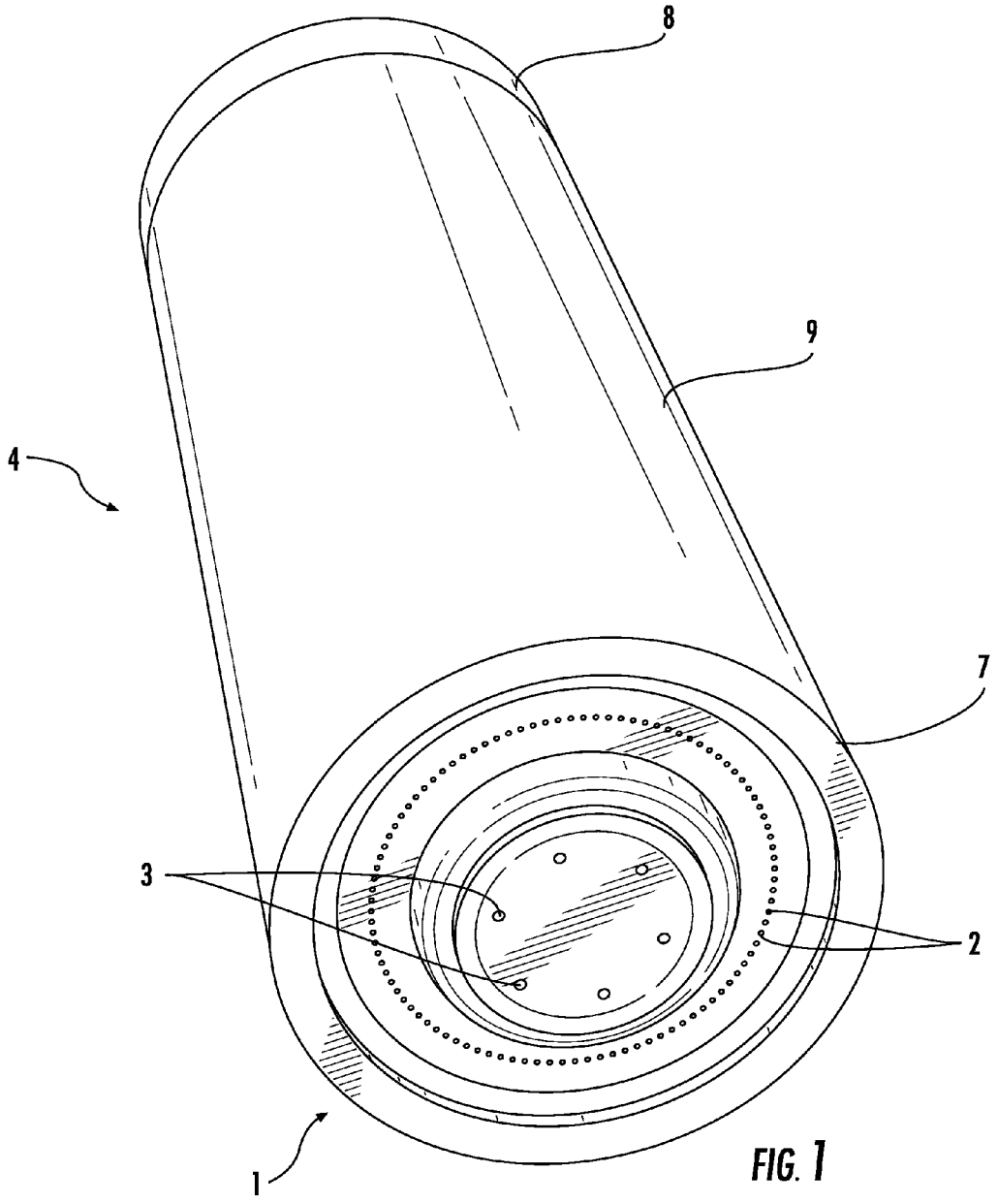
FIG. 1 is a bottom perspective view of a sprayer according to an exemplary embodiment of the disclosure.

Referring to FIG. 1, a sprayer 4 may include an inlet end 8, a dispensing end 7 (e.g., a head portion), and a body portion 9. The inlet end 8 may be fluidly coupled to a fluid supply 6 (not shown in FIG. 1, but, e.g., a water supply line). The body portion 9 may be positioned between the inlet end 8 and the dispensing end 7. Further, the body portion 9 may house a fluid conduit (not shown), which may be used to direct the flow of water from the inlet end 8 to the dispensing end 7. The dispensing end 7 of the sprayer 4 may include a spray head 1 that includes a plurality of holes which are disposed within, extend therethrough, and which are fluidly coupled to the inlet end 8 of the sprayer 4. The sprayer 4 may also include a valve (not shown) which is used to control the flow of water through inlet end 8 of sprayer 4.

The body portion 9 of the sprayer 4 may include multiple channels (not shown in FIG. 1) used to direct the flow of water toward separate portions of the dispensing end 7. Further, each such channel within the body portion 9 may be pressure-regulated separately by valves in order to provide each portion of the dispensing end 7 with a different water pressure. For example, the water pressure experienced within one channel may be increased by a valve or another flow restricting or flow regulating device, thereby increasing the velocity of water flowing through the channel and exiting a plurality of spray nozzles 3.

Further referring to FIG. 1, the spray head 1 is shown to include a plurality of spray holes 2 (e.g., apertures, openings, holes, etc.) and the plurality of spray nozzles 3 (e.g., apertures, jets, nozzles, etc.). The spray holes 2 are shown as being of a same size and arranged in a substantially circular pattern disposed proximate a radially outward location on the spray head. However, the spray holes 2 may have any suitable size and be arranged in any suitable pattern. The spray nozzles 3 are shown as having a same size which is larger than that of the spray holes 2 and arranged in a substantially circular pattern disposed proximate a radially inward location on the spray head 1. However, the spray nozzles 3 may have any suitable size and be arranged in any suitable pattern such as a polygonal or hexagonal pattern.

The spray holes 2 are configured to create a relatively softer (more gentle, etc.), lower velocity fluid flow in the form of a spray 'curtain' of water, when the sprayer is actuated to discharge water from the spray head. The sprayer 4 shown in FIG. 1 is configured such that the lower velocity curtain discharged from the spray holes 2 has sufficient velocity so as to maintain the shape and integrity of the curtain, and to create only a minimal amount of deflection or splashing upon impingement with a spraying surface. The sprayer 4 is also configured such that the spray nozzles 3 create a more forceful, higher velocity fluid flow in the form of a series of streams or 'jets' of water (shown by way of example in FIG. 2), when the sprayer 4 is actuated to discharge water from the spray head. The higher velocity jets of water are intended to provide a sufficiently high mass flow rate and energy to remove debris (e.g. stuck-on food or other materials, etc.) from a surface to be cleaned (e.g. dishes, cookware, etc.). Together (i.e., in combination), the higher velocity jets of water provide a forceful spray of water (e.g. for use in cleaning surfaces, etc.), while the lower velocity curtain, arranged in a substantially coaxial configuration around the higher velocity jets, is intended to minimize 'splashing' associated with deflection of the higher velocity jets upon impingement with a surface or object, by at least partially containing the water from the deflected jets within the boundary of the curtain (as shown by way of example in FIG. 3). In addition, while the curtain is intended to help contain splashing or deflection/reflection of the jets, the curtain is also intended to facilitate rinsing and removal of debris or other material dislodged or loosened from the surface by the jets.

According to an exemplary embodiment, a first channel provided within the body portion 9 may be fluidly coupled to a central portion of dispensing end 7 and fluidly coupled to the spray nozzles 3 (to create a flow path for the jets). Further, a valve (or other flow restriction or flow regulation device) may be used to increase the water pressure within the first channel and discharged through spray nozzle(s) 3, thereby increasing the velocity of water flowing from spray nozzles 3 to form the jets. Therefore, spray nozzles 3 may provide a higher velocity jet or stream of water, thereby increasing the scrubbing power of the water dispensed from spray nozzles 3.

According to an exemplary embodiment, the spray nozzles 3 are arranged in a substantially circular pattern. In other embodiments, the spray nozzles 3 may be arranged in any suitable pattern (e.g., a star or other polygonal pattern). Further, the spray nozzles 3 of the spray head 1 may be fluidly coupled to the fluid supply 6.

Figure 2:
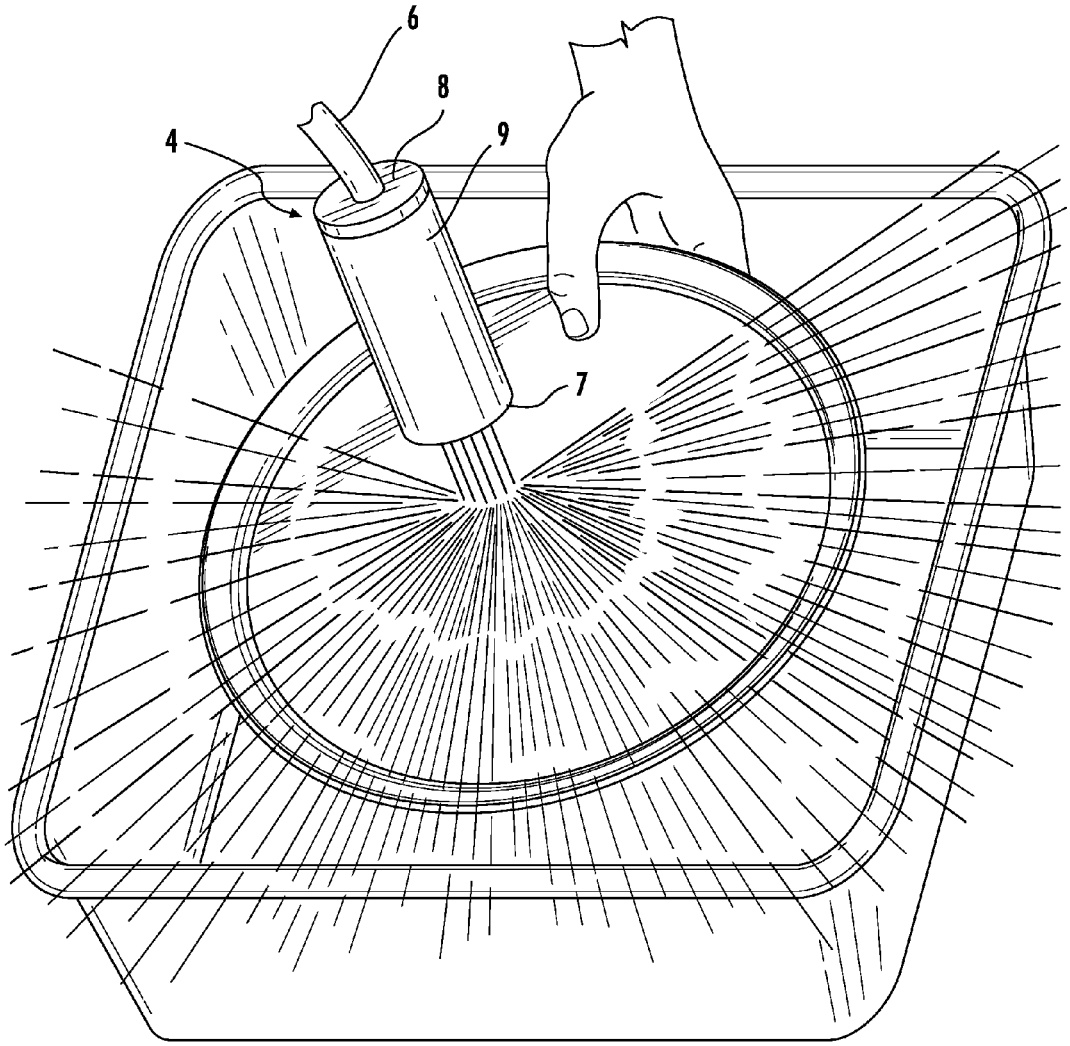
FIG. 2 is a perspective view of the sprayer shown in FIG. 1, which is dispensing water from a central spray nozzle.
Figure 3:
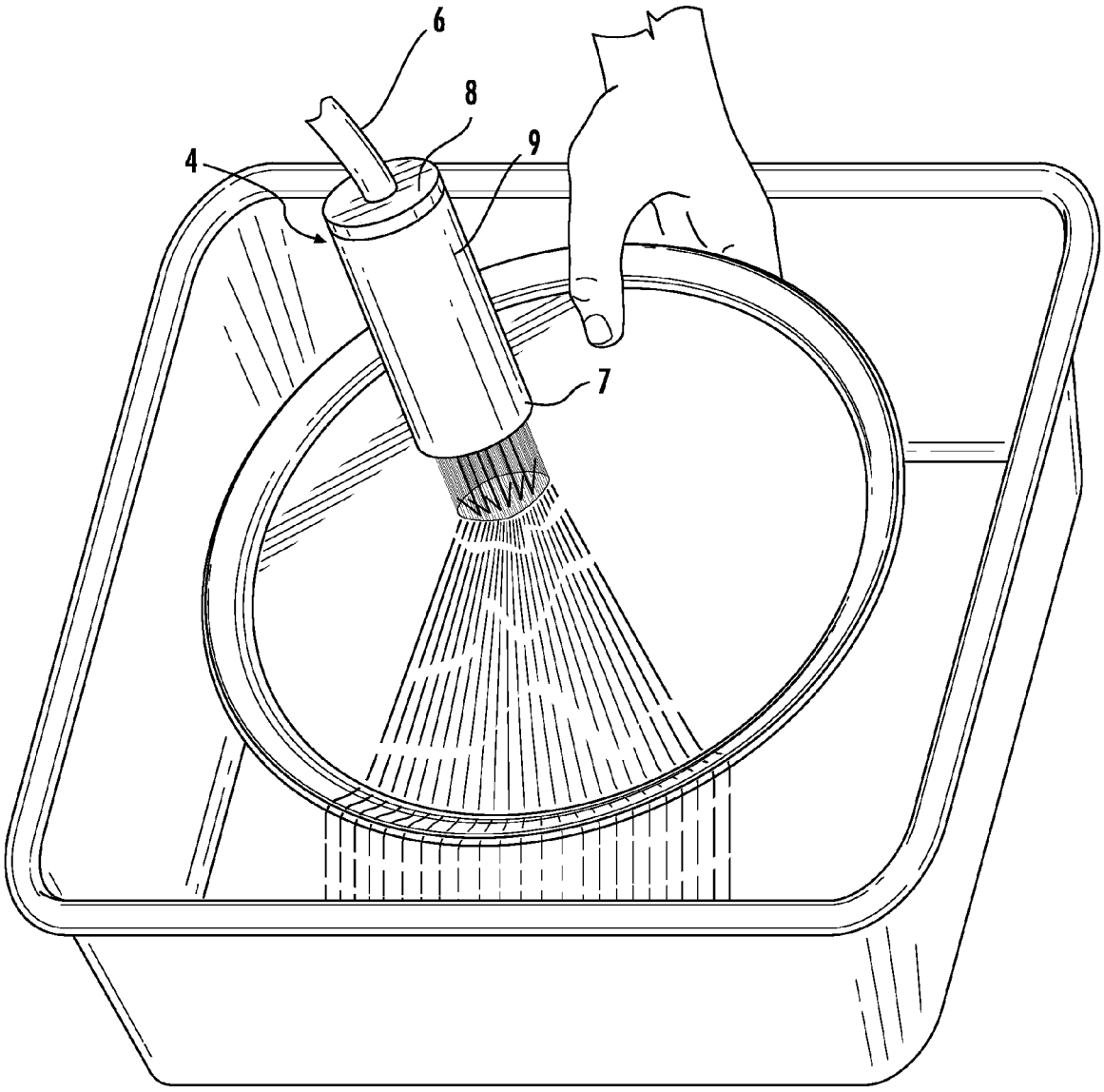
FIG. 3 is a perspective view of the sprayer shown in FIG. 1, which is dispensing water from a central spray nozzle and an outer ring of spray holes.
Figure 4:
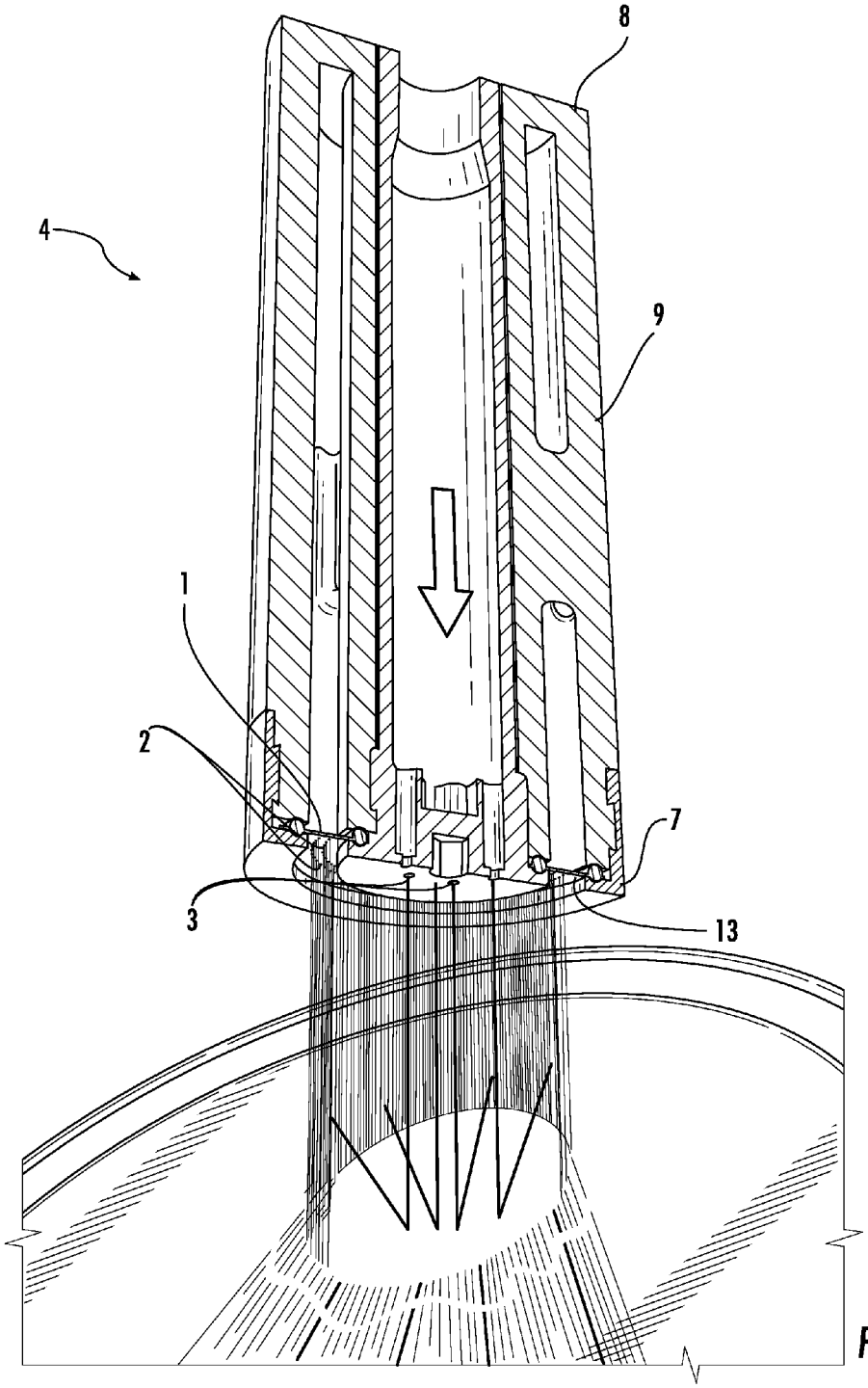
FIG. 4 is a cross-sectional view of the sprayer shown in FIG. 1, which is dispensing water from a central spray nozzle and an outer ring of spray holes.

As shown in FIG. 2, the sprayer 4 may include a setting in which a higher velocity stream of water is dispensed from a radially-inward portion of the spray head and fluid flow from the spray holes 2 is blocked (i.e., the spray nozzle(s) 3 are not surrounded by a lower velocity curtain flow from the spray holes 2). This setting may be characterized by forceful jets of higher velocity water which may have an undesirable tendency to deflect upon impingement with a spraying surface, thereby unintentionally soaking or splashing surrounding objects.

According to an exemplary embodiment, as shown in FIG. 1, the spray holes 2 are arranged as an outer 'ring.' The spray holes 2 are also fluidly coupled to the water supply 6. It should be understood that the spray head 1 may include a greater or lesser number of spray holes 2 which may be arranged in various other patterns. For example, the spray holes 2 may comprise a plurality of rings (i.e., rings having different diameters) that concentrically surround a central spray nozzle 3, or a central ring of spray nozzles 3.

An opening of an individual spray hole 2 may be defined by a bore. According to various embodiments of this disclosure, a fluid may flow through (i.e., be dispensed through) the opening of each spray hole 2 in a first direction A which is substantially parallel to a longitudinal axis of the bore of the spray hole 2. According to an exemplary embodiment of this disclosure, the longitudinal axis of the bore of each spray hole 2 may be axially aligned with, or run parallel to, a longitudinal axis of the spray head 1. Also, the longitudinal axis of each spray hole 2 may be perpendicular to an end surface 13 (e.g., an outer surface) of the spray head 1. Therefore, the outer ring of spray holes 2 may be configured so that water is dispensed from the spray hole openings in first direction A, which is substantially parallel to the longitudinal axis of the sprayer 4, or perpendicular to the end surface 13 of the spray head 1. Further, the openings of the combined spray holes 2 for spray head 1 may be coplanar (i.e., provided in one plane). The bores and openings of the outer ring of spray holes 2 may be configured so that the water dispensed therefrom defines a shape that is substantially cylindrical. Further, the water dispensed from the spray holes 2 may form a lower velocity curtain that surrounds the higher velocity jets 3.

According to an alternative embodiment of the disclosure, the end surface 13 of the spray head 1 may be substantially flat. Alternatively, the end surface 13 may be convex or concave. The bores and openings for the spray holes 2 may be arranged as an outer ring and oriented (i.e., directed) slightly radially outward (i.e., divergent from a central axis of the sprayer). This orientation/configuration is intended to provide a slightly conical curtain spray of water. According to this embodiment, such a slightly conical curtain of water that is dispensed from the spray holes 2 is still configured to shield or contain any water that may be deflected from the water dispensed from the central spray nozzle(s) 3.

According to alternative embodiments of this disclosure, an end surface 13 of a spray head 1 may have a slight curvature (i.e. an end surface which is outwardly convex or concave). For a slightly convex/concave spray head 1, the bores and openings of the spray holes 2 may either be perpendicular to the end surface 13, or directed slightly radially outward.

Depending on the configuration, the spray holes 2 may provide a slightly conical or cylindrical curtain of water. According to these embodiments, the lower velocity curtain of water dispensed from the spray holes 2 may shield any deflected water dispensed from a central spray nozzle(s) 3.

According to various embodiments of this disclosure, a diameter of the openings of the spray holes 2 may be less than a diameter of the openings of the central spray nozzle(s) 3. For example, according to one embodiment, the spray head 1 may comprise approximately 8 spray nozzles 3 having diameters of approximately 1 mm. The spray head 1 may also comprise between about 100-180 spray holes 2 having diameters between 0.28 mm-0.32 mm, and arranged as two concentric outer rings. More specifically, the spray head 1 may comprise between 130-160 spray holes 2 having diameters between 0.28 mm-0.32 mm, and arranged as two concentric outer rings. More particularly still, the spray head 1 may comprise approximately 144 spray holes having approximate diameters of about 0.31 mm, and arranged as two concentric outer rings.

Further, the spray holes 2 may be formed within the spray head 1 using a photo-etching process. However, any suitable method and process may be used to form the spray holes 2, and the present disclosure is not intended to limit the possible ways to form the spray holes 2 within the spray head 1. For example, in other embodiments, a drilling or broaching process may be used to machine the spray holes 2 within the spray head 1.

According to various embodiments of this disclosure, the central spray nozzles 3 and the outer spray holes 2 may be integrally formed within the spray head 1 from one piece, such as a stainless steel disc. For example, a photo-etching process may be used to provide (i.e., form) the plurality of spray holes 2 within a radially outward portion of a disc, and another process (e.g., drilling, punching, etc.) may be used to machine the spray nozzles 3 within a central portion of the disc.

According to an alternative embodiment, the spray head 1 may be formed from separate pieces, each piece including either of the spray holes 2 and the spray nozzles 3. For example, a photo-etching process may be used to form the spray holes 2 onto a stainless steel disc having a central hole. Further, the central hole of the stainless steel disc may be received by another piece (e.g., a disc) which includes a series of central spray nozzles formed therein. The piece including the spray nozzles 3 may be formed from any suitable material (e.g., plastic, a metal, etc.). Various methods, such as an injection molding process, may be used to form a piece including a series of spray nozzles 3 formed within.

According to an exemplary embodiment, the spray holes 2 may be spaced apart from each other by a prescribed distance. For example, according to a particular embodiment, the openings of the spray holes 2 may measure approximately 0.31 mm in diameter, and the spray holes 2 may be spaced approximately 1 mm apart, or less. Advantageously, when the spray holes 2 are arranged approximately 1 mm apart in an outer ring, the water dispensed from the spray holes 2 may be defined by a curtain shape that is substantially cylindrical. Also, the "curtain" may be maintained by using a flow with a lower velocity. The "curtain" formed by the spray holes 2 may surround a stream of higher velocity water dispensed from a series of central spray nozzles 3. Thus, a sprayer 4 may be configured so that water dispensed from the spray holes 2 has a relatively lower velocity than the water dispensed from the inner spray nozzles 3. It should be understood that the spray holes may be spaced apart at any suitable distance, and the distances disclosed herein are not limiting.

Because the outer ring of spray holes 2 of a spray head may radially surround a series of central spray nozzles 3, a lower velocity flow of water dispensed from the outer ring is intended to shield or contain higher velocity water dispensed from an inner spray nozzle which may deflect off a cleaning surface. Therefore, a spray head 1 having a ring of spray holes 2 and a series of central spray nozzles 3 may be configured to provide adequate scrubbing power to clean a spraying surface, while the amount of water that may be deflected or splashed-back off the spraying surface is significantly reduced.

According to various embodiments, the number of spray holes 2 arranged as an outer ring within the spray head 1 may be determined based on a maximum limit for the overall fluid flow rate for the sprayer 4. For example, a maximum flow rate for the sprayer 4 may be 2.2 gallons per minute (gpm). Alternatively, the maximum flow rate for a device used in a shower may be 2.5 gpm. Given a maximum flow rate of 2.2 gpm for the sprayer 4, a combined flow rate for the spray holes 2 may be approximately equal to the combined flow rate for the spray nozzles 3 (i.e., the outer and inner rings may each have a flow rate which is less than or approximately equal to 1.1 gpm). Alternatively, the combined flow rate for the spray holes 2 may be less than the combined flow rate for the spray nozzles 3. For example, the combined flow rate for the spray holes 2 may be approximately 20-30% less than the combined flow rate for the nozzles 3. Also, a given overall flow rate of the nozzles 3 may determine a sufficient overall flow rate for the spray holes 2 in order to provide an effective shielding effect or "curtain." For example, the nozzles 3 may have a given flow rate of approximately 1.0 gpm, and, in order to effectively shield water deflection or splash-back of water from the nozzles 3, an overall flow rate of approximately 0.75 gpm may be selected for the spray holes 2. According to other embodiments, the spray holes 2 may be in the form of one or several curvilinear openings (e.g. arcuate slots, rings, etc.) configured to emit the desired flow of water in the desired pattern (e.g. circular curtain, etc.).

The sprayer 4 may further include one or more valves (not shown) used to separately regulate the flow rates of water dispensed through the spray holes 2 and the spray nozzles 3. Such a valve may allow water to selectively flow through a first channel that directs water to the spray holes 2 and/or a channel that directs water to the spray nozzles 3. Such valve(s) may be operably controlled, for example, by a mechanical or electrical switch provided on an exterior surface of the body portion 9 of the sprayer 4.

According to alternative embodiments of this disclosure, the spray holes 2 may be arranged on a spray head 1 in a non-circular pattern (e.g., a an oval or square). Also, the spray nozzles 3 may be configured to direct water inwardly to a point of intersection or convergence. The spray nozzles 3 may also be configured so that water dispensed therethrough is substantially perpendicular to the end surface 13 of the spray head 1.

One skilled in the art will readily appreciate the benefits of a sprayer that includes an outer ring of spray holes which are arranged and configured to effectively reduce splashing from a central spray nozzle(s). For example, a sprayer may include a powerful central nozzle that dispenses a high velocity stream of water (which also deflects off of a cleaning surface) as well as a series of outer spray holes which dispense water in the form of a protective curtain which effectively contains the deflected water from the central nozzles. As a result, when a person uses a sprayer to wash items (i.e. dishes), he/she may conduct the cleaning operation more efficiently, more effectively, and more accurately.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the sprayer as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A spray head, comprising:

a body portion that receives a supply of fluid; and a head portion in fluid communication with the body portion, wherein the head portion includes an outer surface;

a plurality of spray nozzles and a plurality of spray holes formed within the head portion, the spray nozzles being arranged within a central portion of the head portion, and the spray holes being arranged as an outer ring within the head portion, so that the spray holes surround the spray nozzles;

wherein the spray nozzles are configured to direct a spray having a first velocity therefrom and the spray holes are configured to direct a fluid flow having a second velocity that is lower than the first velocity of the spray in a direction parallel to a longitudinal axis of the body portion;

wherein the spray holes are further configured such that the fluid flow effectively reduces splashing that may result from the spray impacting an object when the supply of fluid is in fluid communication with both the spray holes and the spray nozzles.

2. The spray head of claim 1, wherein when the supply of fluid is in fluid communication with the spray holes, the fluid flow is substantially cylindrical.

3. The spray head of claim 1, further including a valve used to separately regulate the fluid flow and the spray.

4. The spray head of claim 1, wherein the spray head includes between 100 and 180 spray holes having diameters measuring between 0.28 mm and 0.32 mm disposed therein.

5. The spray head of claim 1, wherein the spray holes are formed using a photo-etching process.

6. The spray head of claim 1, wherein the head portion is formed from a stainless steel disc.

7. The spray head of claim 1, wherein the spray holes are arranged as an outer ring are spaced approximately at most 1 mm apart.

8. A spray head, comprising:

a body portion that receives a supply of fluid;

a head portion in fluid communication with the body portion;

a plurality of spray nozzles extending through the head portion and configured to direct a spray having a first velocity from the head portion; and a plurality of spray holes which extend through the head portion, surround the spray nozzles, and are configured to direct a curtain of water having a second velocity lower than the first velocity that substantially contains the spray when the spray holes and spray nozzles are in fluid communication with the supply of fluid;

wherein the spray holes are further configured such that the curtain of water effectively reduces splashing that may result from the spray impacting an object when the supply of fluid is in fluid communication with both the spray holes and the spray nozzles.

9. The spray head of claim 8, wherein when the supply of fluid is in fluid communication with the spray holes, the curtain of water is substantially cylindrical.

10. The spray head of claim 8, wherein when the supply of fluid is in fluid communication with the spray holes, the curtain of water is conical.

11. The spray head of claim 8, further including a valve used to separately regulate the flow curtain of water and the spray.

12. The spray head of claim 8, wherein the spray head includes between 100 and 180 spray holes having diameters measuring between 0.28 mm and 0.32 mm disposed therein.

13. The spray head of claim 8, wherein the spray holes are formed using a photo-etching process.

14. The spray head of claim 8, wherein the head portion is formed from a stainless steel disc.

15. The spray head of claim 8, wherein the spray holes that are arranged as an outer ring are spaced approximately at most 1 mm apart.

16. A spray head, comprising:

a body portion that receives a supply of fluid; and a head portion in fluid communication with the body portion;

a plurality of spray nozzles that extend through the head portion and are configured to direct a spray having a first velocity from the head portion; and a plurality of spray holes spaced approximately at most 1 mm apart extend through the head portion and surround the spray nozzles and are configured to direct a fluid flow having a second velocity lower than the first velocity from the head portion;

wherein when the supply of fluid is in fluid communication with both the spray holes and the spray nozzles, a fluid flow dispensed through the spray holes is substantially cylindrical and surrounds the spray dispensed through the spray nozzles.

17. The spray head of claim 16, wherein the spray holes are formed using a photo-etching process.

18. The spray head of claim 16, wherein the spray holes are configured such that the fluid flow dispensed therethrough effectively reduces splashing that may result from the spray when the supply of fluid is in fluid communication with both the spray holes and the spray nozzles.

19. The spray head of claim 16, wherein the spray head includes between 100 and 180 spray holes having diameters measuring between 0.28 mm and 0.32 mm disposed therein.

20. The spray head of claim 16, wherein the head portion is formed from a stainless steel disc.

21. A spray head, comprising:

a head portion having a central axis;

a plurality of spray nozzles disposed in the head portion and configured to emit jets of water at a first velocity and in a direction substantially parallel to the central axis;

a plurality of spray holes disposed in the head portion and configured to emit a ring of discrete streams of water substantially parallel to, and surrounding, the central axis and the spray nozzles, the spray holes configured to emit the ring of discrete streams of water at a second velocity that surrounds the jets of water emitted by the spray nozzles;

wherein the second velocity is less than the first velocity.

* * * * *